United States Patent [19]

Fischer

[11] 4,454,822

[45] Jun. 19, 1984

[54] GATE ASSEMBLY UNIT FOR BALLAST DISTRIBUTION FROM RAILROAD CAR

[75] Inventor: Robert T. Fischer, Homewood, Ill.

[73] Assignee: Miner Enterprises, Inc., Geneva, Ill.

[21] Appl. No.: 423,949

[22] Filed: Sep. 27, 1982

[51] Int. Cl.[3] ..... B61D 7/00

[52] U.S. Cl. ..... 105/250; 105/282 R; 105/251; 105/282 P; 222/509

[58] Field of Search ..... 49/339, 345, 363; 222/556, 561, 537, 509, 506, 505; 292/186; 105/283, 282 R, 250, 251, 282 P, 290, 296, 299

[56] References Cited

U.S. PATENT DOCUMENTS

| | | | |
|---|---|---|---|
| 609,816 | 8/1898 | Kramer | 105/282 R |
| 3,100,457 | 8/1963 | Dorey | 105/299 |
| 3,241,730 | 3/1966 | Dorey | 105/282 R |

*Primary Examiner*—H. Grant Skaggs

[57] ABSTRACT

A self-contained gate assembly unit for ready attachment to an outlet formed in a hopper-type railroad car allows distribution of ballast in the car to the roadbed below. With the car having outlets positioned over the rails on which the car is supported, an inner or outer plate-like door, slidably carried in guides formed in the unit, may be raised to deposit ballast on either or both sides of either or both rails. Each door is formed with a lower offset lip portion which facilitates door movement in the unit guides.

4 Claims, 6 Drawing Figures

GATE ASSEMBLY UNIT FOR BALLAST DISTRIBUTION FROM RAILROAD CAR

BACKGROUND OF THE INVENTION

1. Field of the Invention

This invention relates to gate assemblies used with hopper-type railroad cars and more particularly to assembly units which may be readily installed on the car and allows selective distribution of ballast in the car to a roadbed below.

2. Prior Art

Gate assemblies which allow the unloading of hopper-type railroad cars are well known. For example, U.S. Pat. No. 609,816 discloses a car body prepared with a pair of chutes to provide for distribution of the car contents on each side of the car. A slidable gate covers an outlet opening formed in each side of the car bottom. By manipulation of a handle operatively connected to each gate, the gate may be drawn upward to uncover the opening. U.S. Pat. No. 1,019,875 discloses a similar gate assembly, except in this case the doors are wedge shaped and slide horizontally to cover and uncover the outlet openings in the car.

U.S. Pat. Nos. 998,325 and 998,326 disclose another form of gate assembly in which sliding doors are used to regulate car unloading. In this case the doors are positioned for a release of material directly beneath the car.

A still further type of gate assembly is disclosed in U.S. Pat. Nos. 3,536,013 and 3,675,591. In this case the doors are large horizontal plates which slide horizontally to uncover an outlet in the car body.

SUMMARY OF THE INVENTION

The gate assembly unit of this invention has a box-like structure to fit about a lower outlet formed in a railroad car bottom and be readily attached thereto. The structure is defined by spaced vertical end panels each having inward extending top and bottom flanges. Attached to the bottom flanges are a pair of horizontal angles which, in turn, support a divider panel. The divider panel is defined by an inner and outer upwardly sloped channel portion which join to form a leading edge.

Attached to an inside of each end panel and above the divider panel is an end wall having downwardly sloped and inwardly extending flanged edges. A bottom of these flanged edges terminate above the divider panel leading edge to provide an opening therebetween.

Connecting with the end walls is an inner and outer sidewall each having downwardly sloped end segments. These segments align vertically with the end wall flanged edges but are at a slight angle offset to define therebetween an inner and outer downward converging door guide. The area between the inner sidewall segments and the outer sidewall segments is cutout to define an inner and outer opening in the unit.

An inner and outer door, each formed in part by a face plate, has ends of each plate positioned within the inner and outer door guides respectively to selectively cover the inner and outer unit openings. Attached to a top portion of each door plate end is a pivot pin which operatively connects with a shaft rotatively carried by the unit end panels. Rotation of the shaft moves the door up the guide to uncover the respective unit opening and discharge ballast to the roadbed below.

To facilitate door movement, each door face plate has a lower offset lip portion which aligns with a pair of slide bars attached to the upper portion of the door face plate. The bars suspend all except the lip portion of the door face plate within the door guides.

The gate assembly unit of this invention provides a number of advantages over gate assemblies heretofore known. First, the assembly is a self-contained unit which may be readily attached to a new hopper-type railroad car or to one already in use. Being a self-contained, ready-to-install unit offers certain commercial advantages.

Next, ballast may be simultaneously distributed on either or both sides of one rail through the unit inner or outer openings.

Lastly, the degree of ballast flow can be accurately regulated between no-flow and full-flow in that the doors are readily movable. During initial door movement from its closed position to its open position, the upper portion of the door is lifted so that there is no contact between the end wall flanged edges and the door slide bars. Contact is limited to the door face plate lip portion and the end wall flanged edges. This lifting action increases the angle between the line of force of the ballast load and the door to reduce the frictional load on the door. Additionally, the area of contact between the door face plate lip portion and the end wall flanged edges is reduced. This combined effect of reducing the frictional lcad and area of contact allows the door to move more easily up the guides.

A second important advantage is that the door guides are self-cleaning. Note that the bottom end of the end wall flanged edges terminates above the divider panel to form an opening through which any particulate lodging in the guide may be expelled as the door moves downward. During this downward movement, contact between the door and the guides is limited substantially to the door face plate lip portion and the door slide bars with the end wall flanged edges. By thus suspending the upper portion of the door face plate within the guide, the door moves smoothly within the guides to cover the unit opening.

DESCRIPTION OF THE PREFERRED EMBODIMENT

Figure 1:
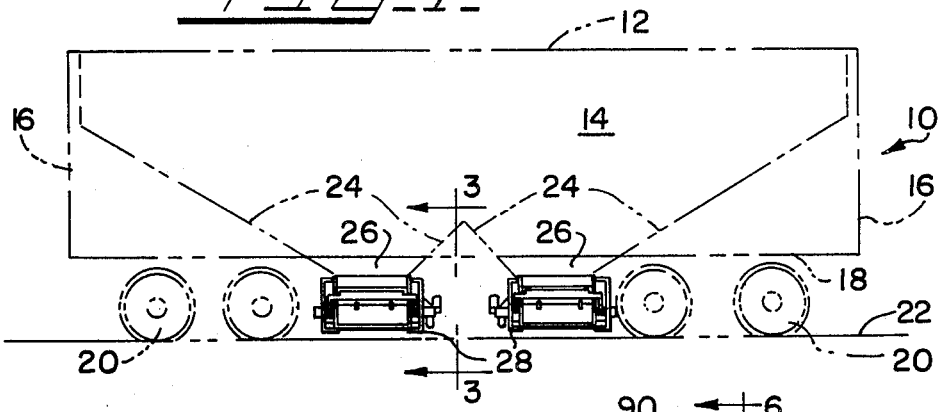
FIG. 1 is a side elevation view of a hopper-type railroad car to which gate assembly units of this invention have been installed.
Figure 5:
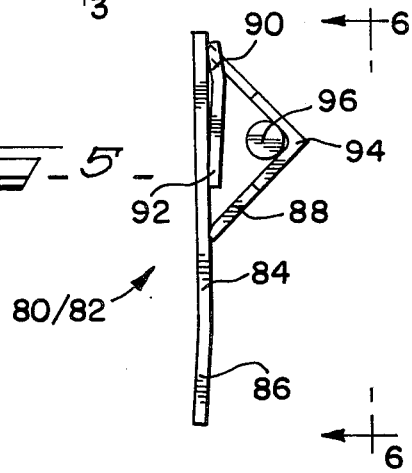
FIG. 5 is an end elevation view of a door forming part of the gate assembly unit.
Figure 6:
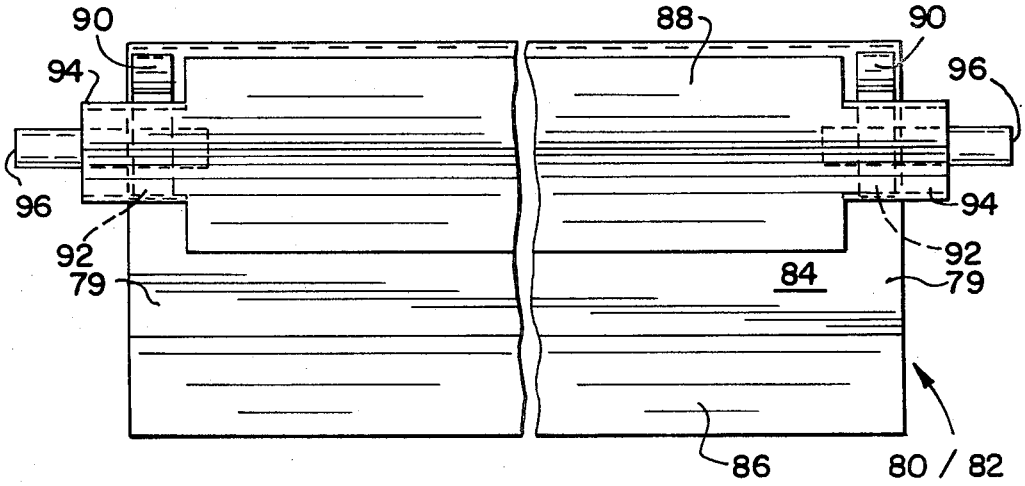
FIG. 6 is a side elevation view of the door as seen generally along the line 6—6 in FIG. 5.

A hopper-type railroad car is shown generally in FIG. 1 and designated 10. The car 10 includes a body 12 defined by spaced sidewalls with one such sidewall shown and designated 14. The sidewall 14 joins end walls 16. A bottom 18 of the car body 12 is supported in a known manner by trucks 20, shown pictorially. Wheels of the trucks 20 engage a pair of rails with one such rail 22 shown.

To facilitate gravity unloading of contents of the car body 12, the car bottom 18 is formed in part by sheets 24 which slope downward and terminate at lower outlets 26. Typically, the car body 12 is formed with four outlets 26 with two such outlets aligned with the rail 22 and the other two outlets (not shown) aligned with the other rail (not shown). Attached below each outlet 26 is a gate assembly unit 28.

All the gate assembly units 28 are similar in construction and therefore only one gate need be described in detail. This description is best understood by concurrently viewing FIGS. 2–6. The unit 28 includes a pair of spaced end panels 30 each formed with a top horizontal flange 32 and a bottom horizontal flange 34. Joined to the bottom flanges 34 adjacent to the outer vertical edges 36 of each panel 30 are one each of a pair of longitudinal angles 38. Each angle 38 is offset so that a leg portion 40 of each angle 38 engages an underside of an inner and outer channel 42,44 of a divider panel 46. The channel 42,44 slope upwardly and join to form a leading horizontal edge 48. The panel 46 further includes pairs of vertical end flanges 50 formed at a right angle to the channels 42,44, respectively.

The gate assembly unit 28 further includes spaced end walls 52. Each end wall 52 has an upper, outwardly sloped attaching flange 54 which fastens to the car bottom sloped end sheets 24. Each end wall 52 further includes a vertical triangular shaped portion 56. The vertical portions 56 have downwardly sloped flanged edges 58 formed with a mitered bottom end 60 best seen in FIGS. 2 and 4.

Joining the end walls 52 are inner and outer sidewalls 62,64. Each sidewall 62,64 also has an upper outwardly sloped attaching flange 66 which fastens to the car bottom sloped side sheets 24. Each sidewall 62,64 further includes an upper vertical portion 68 having ends which join the end walls 52. Extending downwardly from each sidewall upper vertical portion 68 are sloped end segments 70 which respectively define therebetween an inner and outer opening 72,74 in the unit 28. Lower ends of the inner and outer sidewall end segments 70 join the inner and outer channels 42,44 of the divider panel 46.

Figure 2:
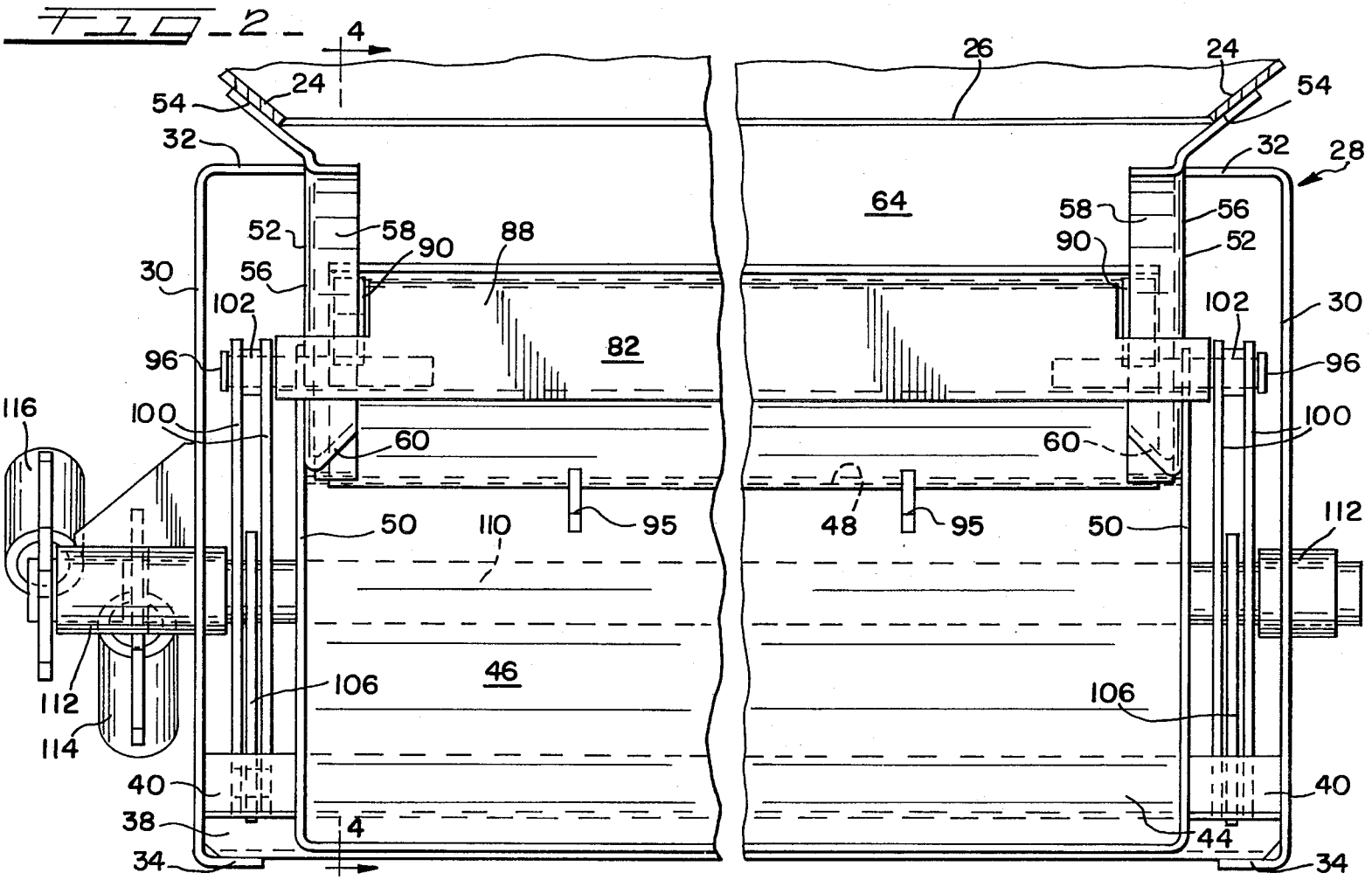
FIG. 2 is a detailed side elevation view, partially in section, of the gate assembly unit of FIG. 1.
Figure 3:
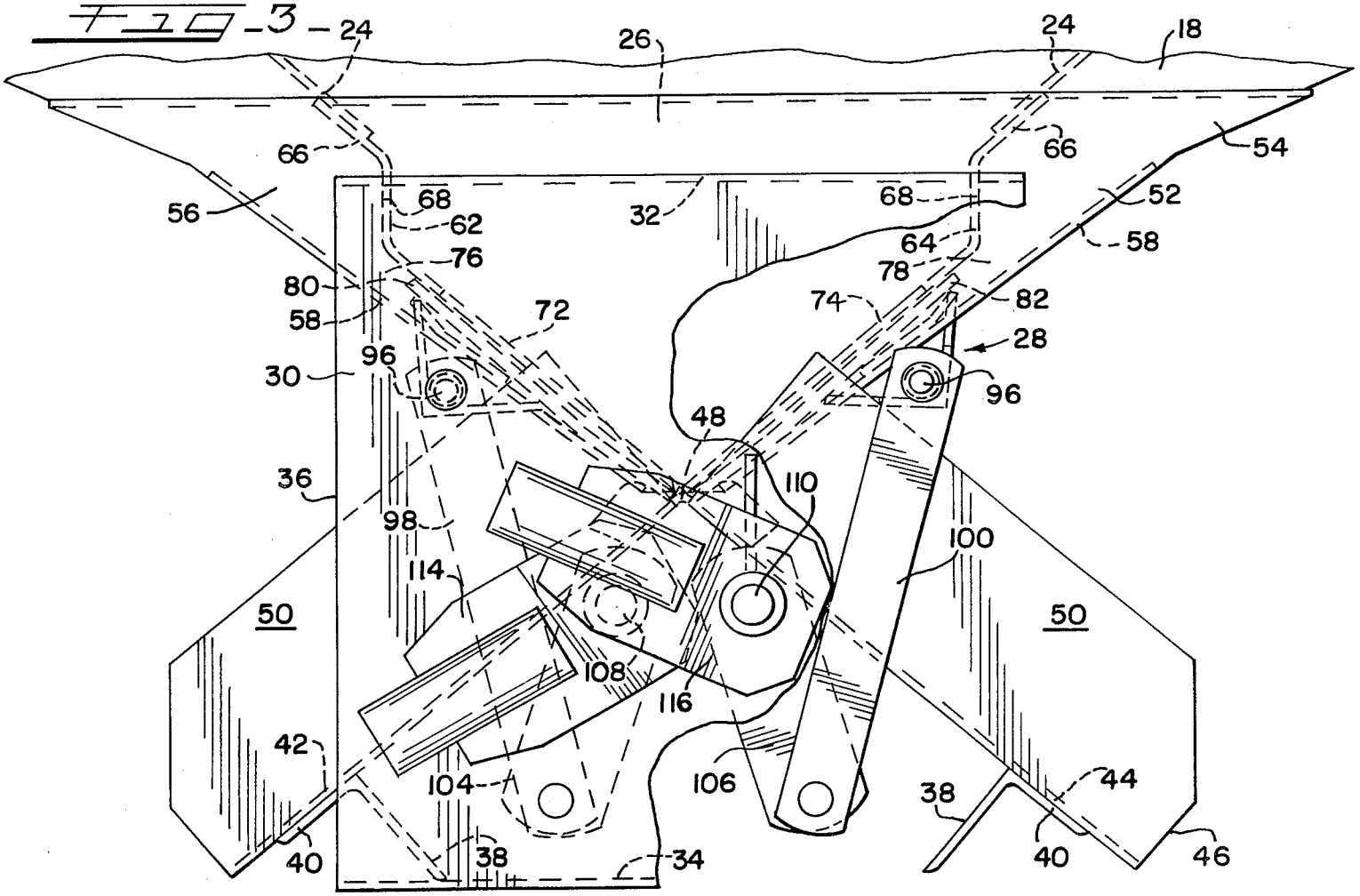
FIG. 3 is an end elevation view of the gate assembly unit with a portion cutaway as seen generally along the line 3—3 of FIG. 1.
Figure 4:
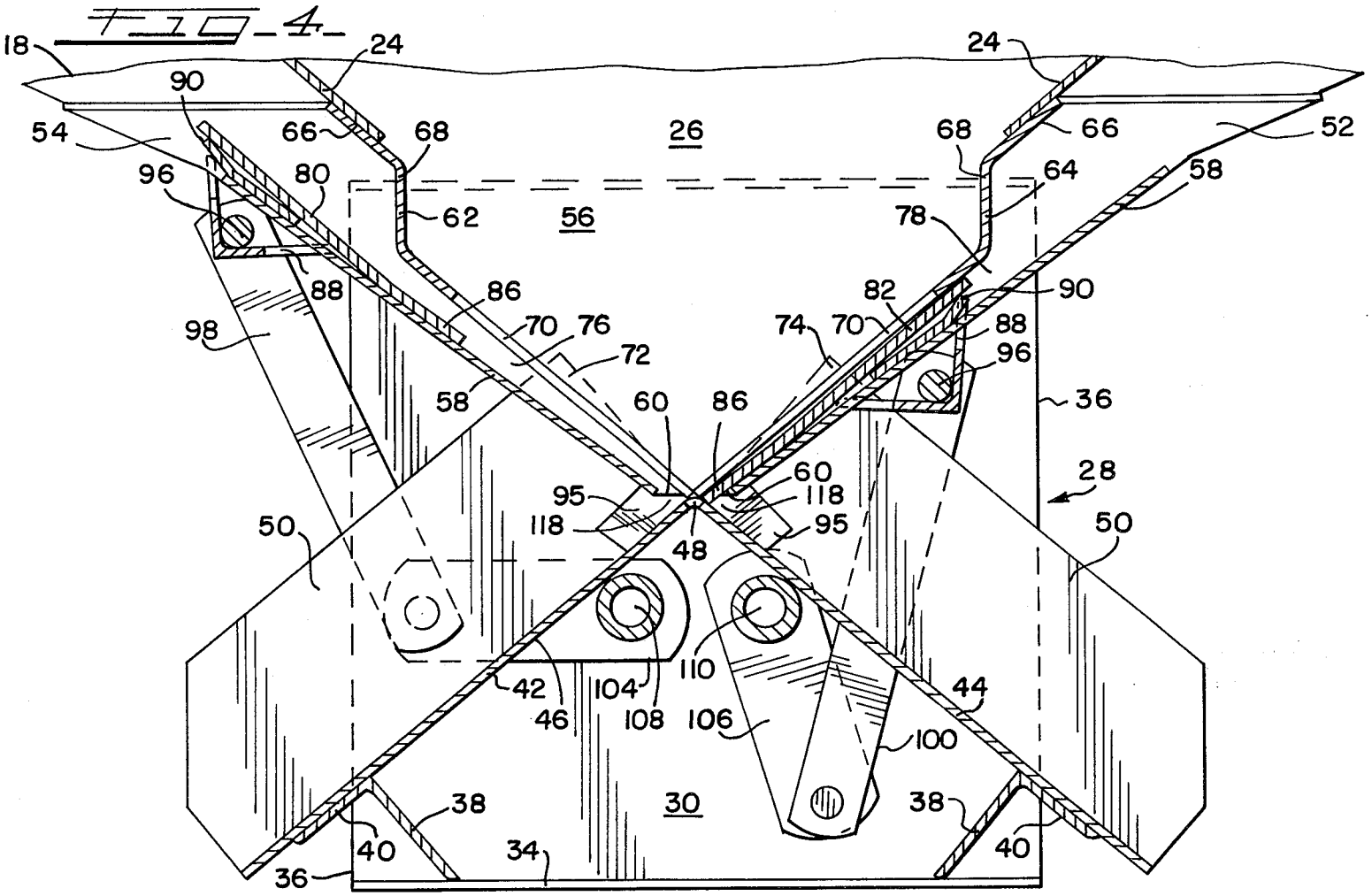
FIG. 4 is a sectional view of the gate assembly unit as seen generally along the line 4—4 in FIG. 2.

As best seen in FIGS. 3 and 4, the end wall flanged edges 58 and the sidewall end segments 70 are spaced apart and sloped at a slightly different angle to form inner and outer downwardly converging door guides 76,78. End portions 79 of an inner and outer door 80,82 are disposed in these guides 76,78. Construction of the doors 80,82 is best understood by viewing FIGS. 5 and 6. Each door 80,82 has a face plate 84 formed with a bottom offset lip portion 86. Attached to an outer side of each door face plate 84 is an angle 88. Ends 94 of the angle 88 are notched to provide clearance for attachment of slide bars 90. Each slide bar 90 has a lower element 92 which is positioned parallel to the door face plate bottom offset lip portion 86. At each angle end 94 of the door angles 88 is a pivot rod, 96 which extends outwardly therefrom. As seen in FIGS. 2 and 4, a center portion of each door face plate lower lip portion 86 engages a pair of guide tabs 95 when the doors 80,82 are closed.

Attached to the door pivot rods 96 of the inner and outer door 80,82 are ends of pairs of inner and outer door linkage arms 98,100. A spacer 102 located on each rod 96 maintains the pairs of arms 98,100 in a spaced relationship. Opposite ends of the linkage arm pairs 98,100 are pivotally attached to ends of inner and outer door toggle arms 104,106. Opposite ends of the toggle arms 104,106 are, in turn, fastened to an inner and an outer door shaft 108,110. Ends of these shafts 108,110 are journaled in bearing devices 112 attached respectively to the end panels 30.

An outer door bar holder 114 is fastened to one end of the outer door shaft 108 while an inner door bar holder 116 is fastened to the like end of the inner door shaft 110. An end of an operating bar (now shown) may be conveniently inserted in the holders 114,116 to rotate the shafts 108,110. Note that the holders 114,116 are offset to allow a simultaneous rotation of boths shafts 108,110.

With the car body 12 filled with ballast and transported to a section of roadbed undergoing maintenance, the ballast may be selectively distributed to the roadbed below by rotation of either or both of the bar holders 114,116. Rotation of the outer door bar holder 114 clockwise causes a like rotation of the outer door shaft 108 which, in turn, swings the outer door toggles 104 upward. The outer door 80 is thus lifted by the pairs of outer door linkage arms 98. This lifting action raises the outer door slide bars 90 from contact with the flanged edges 58 of the end walls 52. Concurrent with this raising, the door face plate lip portion 86 is partially lifted to reduce the area of contact with the end wall flanged edges 58.

These lifting and raising movements of the outer door 80 reduces the static frictional forces between the inner door face plate 84 and the ballast in the car body 12 and between the door face plate lip portion 86 and the end wall flanged edges 58. The outer door 80 thus may move smoothly up the inner door guides 76. A 70 degree rotation of the bar holder 114 fully uncovers the inner opening 72 allowing ballast to flow through the car outlet 26, the unit inner opening 72, and on to the divider panel outer channel 42 to be distributed outside the rail 22. A counterclockwise rotation of the inside door bar holder 116 produces a like result. In this case ballast is distributed inside of the rail 22.

To close a door, for example, the outer door 80, the bar holder 114 is rotated counterclockwise which slides the outer door 80 down the outer door guides 76. During this movement the lip portion 86 and the lower elements 92 of the slide bars 90 of the inner door 80 remain substantially aligned and in full contact with the end wall flanged edges 58. Any small piece of aggregate which may have become lodged in the guides 76 is forced down the guides 76 and discharged through openings 118 provided by the mitered lower ends 60 of the end wall flanged edges 58, see FIG. 4.

I claim:

1. A gate assembly unit particularly adapted for installation to a bottom outlet of a hopper-type railroad car to provide regulation of a material discharge through said car outlet, said unit comprising, a unit body defined by spaced inner and outer sidewalls joined by end walls with said body fitting about said outlet, an inner and outer opening formed in said inner and outer sidewalls respectively with sides of said opening formed by sloped segments of said sidewalls, a divider panel carried by said body between said end walls with ends of said sidewall segments connecting with said divider panel adjacent to a leading edge of said divider panel, inner door guides and outer door guides formed by said sidewall end segments and flanged edges of said end walls, said flanged edges and said end segments offset to converge toward said divider panel leading edge, an inner and outer plate-like door having end portions disposed in said inner and outer door guides respectively with said doors selectively covering said inner and outer openings, an upper portion of each said door suspended in said respective guides by slide means, and a lower lip portion of each said door offset to align with said slide means, and inner and outer door operative means carried by said unit body and connected to said end portions of said inner and outer door respectively, said means raising and lifting said doors to reduce frictional forces on said doors and allow a smooth upward movemen of said doors in said door guides to uncover said respective unit openings.

2. In a hopper-type railroad car for carrying ballast, said car having a body formed with bottom outlets defined in part by sloped sheets with said outlets aligning with rails supporting said car, and gate assembly units carried by said car bottom below each said outlet to regulate a discharge of said ballast through said outlets, said gate assembly unit comprising, a pair of spaced end panels, a pair of angles attached to bottom flanges of said end panels, a divider panel having upwardly sloped channel portions fastened to said angles between said end panels, a pair of spaced end walls having upper attaching flanges for connection with said car bottom sheets and downwardly sloped, inner extending flanged edges, said end walls attached one each to a top flange of said end panels with bottoms of said flanged edges terminating above a leading edge of said divider panel to form in part guide openings an inner and outer sidewall spaced apart and connecting with said end walls, each said sidewall having a cutout to form an inner and outer opening in said unit with said opening defined in part by downwardly sloped end segments vertically aligning with said end wall flanged edges, and said end wall flanged edges and said sidewall end segments angularly offset and spaced apart to form a pair of inner door guides and a pair of outer door guides, an inner and outer door comprising a face plate having a bottom offset lip portion and a pair of slide bars attached to an upper portion of each said door plate and positioned for contact with said end wall flanged edges of said inner and outer door guides respectively with end portions of said doors disposed in said guides to selectively cover said openings, said slide elements aligning with said face plate bottom offset lip portion so as to suspend said upper portion of said face plate in said guides, and an inner door and an outer door slide means to move said doors in said door guides respectively, each slide means connecting ends of an inner and outer door shaft with pivot rods attached to said end portions of each said door, said means during an upward movement of said door to uncover said opening lifting and raising said door to reduce friction forces on said door, and during a downward movement of said door to cover said opening maintaining said offset lip portion of said door face plate in a position to dislodge ballast in said door guides through said guide openings, wherein said doors may be selectively moved to uncover said unit openings allowing ballast to be discharge from said unit on both or either side of a rail.

3. A gate assembly unit as defined by claim 2 and further characterized by said bottom of said end wall flanged edges formed with a miter to define in part said guide openings.

4. A gate assembly unit as defined by claim 2 and futher characterized by, a 70 degree rotation of said inner and outer door shafts moving said inner and outer doors between a fully open and a fully closed position.

* * * * *